United States Patent [19]

Pietsch et al.

[11] 4,438,076

[45] Mar. 20, 1984

[54] METHOD OF EXTRACTING GOLD AND SILVER FROM AN ORE

[75] Inventors: Hartmut Pietsch, Bad Homburg; Wolfgang Türke, Schöneck; Ernst Bareuther, Butzbach; Fritz Kämpf; Hubert Bings, both of Lünen, all of Fed. Rep. of Germany

[73] Assignees: Metallgesellschaft AG, Frankfurt am Main; Vereinigte Aluminum-Werke AG, Bonn, both of Fed. Rep. of Germany

[21] Appl. No.: 523,022

[22] Filed: Aug. 12, 1983

Related U.S. Application Data

[63] Continuation of Ser. No. 391,959, Jun. 24, 1982, abandoned.

[30] Foreign Application Priority Data

Jul. 3, 1981 [DE] Fed. Rep. of Germany ..... 3126234

[51] Int. Cl.[3] ..... C22B 11/08

[52] U.S. Cl. ..... 423/30; 423/31; 75/99; 75/105; 75/118 R; 204/DIG. 13

[58] Field of Search ..... 75/118 R, 99, 105; 204/DIG. 13; 423/31, 30

[56] References Cited

U.S. PATENT DOCUMENTS

| | | | |
|---|---|---|---|
| 1,198,011 | 9/1916 | Crowe | 423/30 |
| 3,443,932 | 5/1969 | Melin et al. | 75/101 R |
| 4,177,068 | 12/1979 | Balakrishman et al. | 75/118 R |
| 4,190,436 | 2/1980 | Hughes | 75/118 R |

FOREIGN PATENT DOCUMENTS 1937392 2/1972 Fed. Rep. of Germany .

OTHER PUBLICATIONS

"Some Factors Influencing the Rate of Dissolution of Gold in Sodium Cyanide Solutions", pp. 55–60, (Canadian Article).

Lehrbuch der Metallhüttenkunde-by Dr. Ing. Victor Tafel et al., *Copy of Standard Research Report.

Article Entitled "The Gold-Dissolution Rate in Cyanide Solutions", by A. W. Fahrenwalt et al.

*Principles of Extractive Metallurgy* Fathi Habashi, vol. 2, pp. 15–16 and 24–30.

*Primary Examiner*—Edward J. Meros

*Assistant Examiner*—Robert L. Stoll

*Attorney, Agent, or Firm*—Karl F. Ross; Herbert Dubno

[57] ABSTRACT

Gold and/or silver is leached from comminuted ore with an alkaline cyanide lixiviant at a superatmospheric pressure of at least 25 bar and with high purity oxygen (at least 90% pure) to reduce the residence time at high yield.

8 Claims, No Drawings

METHOD OF EXTRACTING GOLD AND SILVER FROM AN ORE

This application is a continuation of application Ser. No. 391,959, filed June 24, 1982, now abandoned.

FIELD OF THE INVENTION

Our present invention relates to a process for recovering gold and silver from an ore containing same and, more particularly, to a process for leaching gold and silver from ore with an alkaline cyanide solution or lixiviant.

BACKGROUND OF THE INVENTION

Gold and silver can be recovered from an ore containing same by comminuting the ore and treating the subdivided product with a lixiviant in the form of an alkaline cyanide solution in tanks to which air is supplied to raise the oxygen content of the leaching solution. Such systems are described by Victor Tafel, *Lehrbuch der Metallhuenkunde,* 1951, volume 1, pages 31 to 34.

The residence times in the tank for the solids are extremely long, e.g. 20 to 40 hours, for high yields or recoveries.

It is also known that the solubility of gold increases with increasing partial pressure of oxygen in the leaching solution and falls after having reached a maximum (see page 17 of the Tafel publication mentioned previously). In *Engineering and Mining Journal,* volume 140, No. 1, 1939, pages 44 through 46, investigations with an oxygen partial pressure of 0.21 to 8.3 bar have been described and it is here pointed out that under these conditions maximum solubility is exceeded.

Apparently this teaching or knowledge of this fact has limited attempts to utilize superatmospheric pressure in leaching systems for the purposes described inasmuch as one could not expect, based upon these teachings, any increase in the gold or silver solubility and indeed from the earlier knowledge with respect to peaking of the solubility, one would expect a decrease in solubility to follow the maximum described by Tafel.

OBJECTS OF THE INVENTION

It is the principal object of the present invention to provide a method of recovering gold and silver from an ore whereby the leaching time can be reduced.

Another object of this invention is to provide an improved process for leaching gold and/or silver from an ore containing same which yields the desired products in high yields while reducing the time required for the leaching thereof from the ore.

SUMMARY OF THE INVENTION

These objects, and others which will become apparent hereinafter are attained in accorance with the present invention which is based upon our most surprising discovery that the use of a superatmospheric pressure greater than 25 bar, coupled with the supply of high purity oxygen to the lixiviant, can greatly reduce the leaching time while nevertheless providing a high yield and can improve the yield for extremely short leaching times.

According to the invention, therefore, gold and silver are leached from an ore containing same, after comminution of this ore by entraining the comminuted ore in a tubular reactor as a suspension in an alkaline cyanide solution at a pressure of 25 to 130 bar while introducing oxygen from a supply thereof such that the introduced gas has a purity of at least 90%, i.e. consists of at least 90% by volume oxygen.

A tubular reactor, as this term is used in the instant application, comprises a long tube which can be helically coiled, i.e. which is provided with convolutions.

The suspension of the ore in the alkaline cyanide solution is preferably maintained in a turbulent state within this reactor, i.e. is passed through the latter so that a Reynolds number assuring turbulence is maintained.

The reactor may be of the configuration shown in the German Pat. No. 1,937,392.

Most advantageously the leaching is effected at a temperature above the freezing point of the solution but below about 70° C., with best results being obtained at temperatures between room temperature, e.g. 20° C., and 70° C. While the method is effective at temperatures above 70° C., the results tend to be poorer between 70° C. and the boiling point of the solution.

We have also found that the slurry flow rate may be important and we have obtained best results with a flow velocity of 0.8 to 3 meters per second. The most effective results are obtained with a slurry flow velocity of 1.5 to 2.5 meters per second in the tubular reactor.

While practically any solids content can be used in the slurry according to the invention, we have found that the solids content should not exceed about 1200 grams per liter and should be at least 300 grams per liter. In the most preferred operation the slurry has a solids content of 700 to 1000 grams per liter.

SPECIFIC EXAMPLES

In the following examples a gold ore having the following composition was leached:

Gold: 19.8 grams per metric ton $SiO_2$: 88% by weight $FeS_2$: 1.5% by weight

Balance: substantially iron, aluminum and calcium oxides.

Note that when the ore also included about 5 grams per metric ton of silver, a recovery of silver, similar to that of gold, was obtained in terms of percent extracted.

For all of the examples described below, the ore was slurried in water with a weight ratio of ore to water being 1:1, the pH of the slurry was adjusted to 10.5 to 11 by the addition of milk of lime (dilute aqueous calcium hydroxide). 0.7 grams of sodium cyanide was added per kg. of ore and the oxygen bubbled into the slurry as it entered the reactor had a purity of 99.8 to 99.9%.

EXAMPLE 1

The experimental tubular reactor had a reactor tube whose total length was 680 meters and the slurry was fed to this tube at a rate of 3 meters cube per hour. The tube configuration corresponded to that of German Pat. No. 1,937,392.

Oxygen was supplied to the slurry which was at a temperature of 50° C. and the pressure in the tubular reactor was maintained at 115 bar. One pass through the reactor corresponded to a residence time of 5 minutes.

The lixiviant was separated from the solids after one pass through the tube and the solid residue was found to contain 1.5 grams of gold per metric ton (1000 kg.). When the slurry was passed again through the tube for a total residence time of 10 minutes, the gold content amounted to 0.7 grams per metric ton. This represents a recovery of gold of 96.47%.

The following examples were carried out in a laboratory autoclave having a capacity of 1000 $cm^3$ and filled with 500 $cm^3$ of the slurry. To simulate the rheology and flow conditions of the slurry in the tube reactor, a stirrer in the autoclave was driven at extremely high peripheral speed (8 meters per second). In each case parameters were varied and the gold content of the residue after separating the same from the lixiviant was measured and the recovery or yield calculated.

EXAMPLE 2

The ore was treated for 25 minutes at 20° C. with oxygen being supplied at 25 bar. After filtration of the lixiviant, the residue was found to contain 1.26 grams per metric ton of gold, corresponding to a recovery of 93.64%.

EXAMPLE 3

The ore was heated in the autoclave to a temperature of 50° C. Otherwise the conditions of Example 2 were observed. The gold content of the residue was 0.67 grams per metric ton corresponding to a yield or recovery of 96.62%.

EXAMPLE 4

The parameters of Example 3 were observed except that the oxygen was supplied at a pressure of 50 bar. The gold content in the residue was 0.62 grams per metric ton corresponding to a yield of 96.87%.

EXAMPLE 5

The procedure of Example 3 was followed except that oxygen was supplied at 90 bar. The gold content of the residue was 0.58 grams per ton corresponding to a yield of 97.07%.

EXAMPLE 6

The treatment followed that of Example 3 except that the oxygen was introduced at a pressure of 115 bar. The gold content in the residue was 0.57 grams per ton, corresponding to a yield of 97.12%.

For 0.7 g of NaCN per liter, the following relationship as to $CN/O_2$ applies:

0.7:49 (Molar weight)$=14.3\cdot10^{-3}$ mol/l soluble oxygen at 760 Torr and 50° C.

$=2.6\cdot10^{-3}$ g/100 g $H_2O$ (a) 25 bar:

$$2.6\cdot10^{-3}\times10\times25=0.65 \text{ g } O_2/l \text{ soluble}$$

$$0.65/32=20.3\cdot10^{-3} \text{ mol } O_2/l$$

$$\frac{CN}{O_2}=\frac{14.3\cdot10^{-3}}{20.3\cdot10^{-3}}=0.7$$

(b) 115 bar:

$$20.3\cdot10^{-3}\times115/25=93.4\cdot10^{-3} \text{ mol } O_2/l$$

$$\frac{CN}{O_2}=\frac{14.3\cdot10^{-3}}{93.4\cdot10^{-3}}=0.153$$

We claim:

1. A method of recovering at least one element selected from the group which consists of gold and silver from an ore containing same, comprising the steps of:
   forming a slurry of the ore in an aqueous alkali cyanide solution; and
   maintaining said slurry in a turbulent state at a pressure of 25 to 130 bar by passing it through a tube reactor in continuous unidirectional flow, while injecting oxygen of a purity of at least 90% into said slurry in said tube reactor at said pressure so that the $CN/O_2$ molar ratio is at most 0.7 at 25 bar and 0.7 g/l NaCN and is lower at higher pressures whereby said element is leached from said ore.

2. The method defined in claim 1 wherein the slurry is maintained in said tubular reactor at a temperature of at most 70° C. during the leaching.

3. The method defined in claim 2 wherein the flow velocity of the slurry in said reactor is 0.8 to 3 meters per second.

4. The method defined in claim 3 wherein said flow velocity is 1.5 to 2.5 meters per second.

5. The method defined in claim 3 wherein said slurry is provided to have a solids content of 300 to 1200 grams per meter.

6. The method defined in claim 5 wherein said solids content is 700 to 1000 grams per liter.

7. The method defined in claim 6 wherein the temperature of said slurry in said reactor is maintained at at least 20° C. room temperature.

8. The method defined in claim 6 wherein said oxygen is introduced into said slurry with a purity of at least 99.8%.

* * * * *